United States Patent [19]

Gotoh

[11] 4,067,365

[45] Jan. 10, 1978

[54] APPARATUS OF STOPPING OPERATION OF A WEAVING LOOM

[76] Inventor: Miyuki Gotoh, 4-48-21, Midori-cho, Tokorozawa, Japan

[21] Appl. No.: 663,141

[22] Filed: Mar. 2, 1976

[30] Foreign Application Priority Data

Mar. 6, 1975 Japan ..... 50-27384

[51] Int. Cl.[2] ..... D03D 51/18

[52] U.S. Cl. ..... 139/370.1; 139/336

[58] Field of Search ..... 139/336, 348, 349, 370, 139/371; 66/161, 162, 166

[56] References Cited

U.S. PATENT DOCUMENTS

| | | | |
|---|---|---|---|
| 3,410,316 | 11/1968 | Giuttari | 139/370.2 |
| 3,613,743 | 10/1971 | Sakamoto | 66/166 |
| 3,678,969 | 7/1972 | Gotoh | 139/336 |
| 3,802,468 | 4/1974 | Meyer et al. | 139/370.2 |
| 3,967,656 | 7/1976 | Gotoh | 139/370.2 |

*Primary Examiner*—Henry S. Jaudon

*Attorney, Agent, or Firm*—Robert E. Burns; Emmanuel J. Lobato; Bruce L. Adams

[57] ABSTRACT

Operation of a weaving loom is stopped when tension in warp yarn less than a reference value at beat-up is successively sensed at a plurality of successive beat-ups.

3 Claims, 3 Drawing Figures

APPARATUS OF STOPPING OPERATION OF A WEAVING LOOM

BACKGROUND OF THE INVENTION

The present invention relates generally to a method of and an apparatus for stopping operation of a weaving loom when a weft yarn is not completely inserted into the warp shed and particularly to a method of and apparatus for stopping operation of the loom when tension in warp yarn is successively less than a base value at a plurality of successive beat-ups.

As is well known in the art, when a weft yarn has been not completely or normally inserted into the warp shed of a weaving loom or has not reached a desired position, it is necessary to stop operation of the loom to prevent faulty fabric from being woven. For this purpose, a method has been proposed in which operation of the loom is stopped whenever tension in the warp yarn is lower than a reference value at beat-up. The method utilized is that when a weft yarn is completely inserted into the warp shed, tension in the warp yarn exceeds a constant value upon beat-up, but when a weft yarn is not completely inserted into the warp shed, tension in the warp yarn is lower than the constant value upon beat-up.

However, it has been discovered that tension in the warp yarn is sometimes lower than the reference value upon beat-up so that according to the conventional method operation of the loom is stopped notwithstanding that a weft yarn has been completely inserted into the warp shed. This is because of the back rest roller being abnormally vibrated by vibration of the loom so that tension in the warp yarn is lower than the reference value at beat-up even if a weft yarn has been completely inserted into the warp shed. An unnecessary stoppage of operation of the loom results in a reduction in the rate of operation of the loom.

When a weft yarn has been completely inserted into the warp shed, tension in the warp yarn is sometimes lower than the base value owing to an external cause or factor as mentioned above, however the tension in the warp yarn is never successively lower than the base value at a plurality of successive beat-ups. On the contrary, since, when a weft yarn has not been completely or normally inserted in the warp shed at a cycle of the loom, the fell of woven fabric is advanced by a share of a non-inserted weft yarn at the next cycle of the loom to provide a portion lacking in a weft yarn into the woven fabric, tension in the warp yarn is reduced below the base value at the beat-up of this cycle due to this portion irrespective of the fact that a weft yarn has been normally inserted into the warp shed at the cycle or not. Accordingly, in this instance, the tension in the warp yarn is successively lower than the base value at a plurality of successive beat-ups.

SUMMARY OF THE INVENTION

It is, therefore, an object of the invention to provide a method and an apparatus in which operation of a weaving loom is stopped when tension in the warp yarn is successively lower than a reference value at a plurality of successive beat-ups.

BRIEF DESCRIPTION OF THE DRAWINGS

The invention provides an apparatus for stopping the operation of a weaving loom when the woven fabric of the weaving loom lacks a weft yarn completely inserted. The apparatus comprises first means for sensing the tension in the warp yarn existing between a back rest roller of the weaving loom and the fell of the woven fabric at each beat-up and for generating a first signal having a value representative of the tension sensed in the warp yarn. Second means electrically connected to the first means are provided for comparing the value of the first signal from the first means with a reference value and for generating a second signal when the value of the first signal from the first means is greater than the reference value. A pulse generator generates a pulse signal at each cycle of the weaving loom. Third means are electrically connected to the pulse generator and to the second means and comprises means for adding the pulse signals from the pulse generator as a one-by-one reception of the pulse signals takes place to get a total thereof at each reception of the pulse signal. Restoring means restore the total to zero in response to the second signal from the second means; and means for generating a third signal for stopping the operation of the weaving loom stop the loom when the total has reached a predetermined number exceeding two.

Further features and advantages of the invention will become more apparent from the following detailed description taken in connection with the accompanying drawings in which.

DESCRIPTION OF THE PREFERRED EMBODIMENTS

Figure 1:
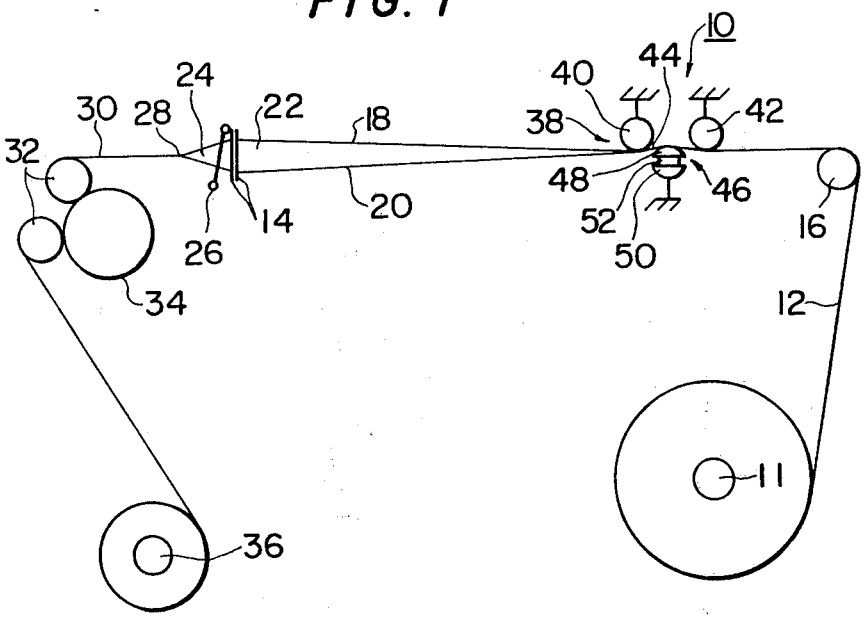
FIG. 1 is a schematic view of one part of a preferred embodiment of an apparatus according to the invention.

Referring to FIG. 1 of the drawings, there is shown a weaving loom incorporating thereinto an apparatus according to the invention, generally designated by the reference numeral 10. The loom includes a warp beam 11 from which warp yarn 12 is drawn off to healds 14 by way of a whip or back rest roller 16. The healds 14 provide upper and lower sheets 18 and 20 of the warp yarn 12 which extend in their tensioned state so as to form a shed 22 therebetween and are alternately reversed by the healds 14. Provision of a shuttle or a weft injection nozzle (not shown) is made for inserting a predetermined legnth of weft yarn 24 into the warp shed 22. The loom also includes a reed 26 which is operated to beat-up the length of weft yarn 24 to the fell 28 to produce a fabric 30. The fabric 30 thus woven is pulled by press rollers 32 and a friction roller 34 and is then supplied to a cloth roller 36, where the fabric sheet 30 is wound thereon.

The apparatus 10 comprises a warp tension sensing device 38 which is located in the path of the warp yarn 12 existing between the back rest roller 16 and the healds 14 or the fell 28 and senses tension in the warp yarn 12 to generate an electric signal. The device 38 comprises first and second guide rollers 40 and 42 located on an upper side of the warp yarn sheet 12 and spaced along the length of the warp yarn 12 and engaging a suitable number of the warp yarns 44, for example, positioned at an end of the warp yarn sheet 12, and a sensor 46 located on a lower side of the warp yarn sheet 12 between the rollers 40 and 42. The sensor 46 includes a movable guide member 48 engaging and guiding the warp yarns 44, a stationary support member 50 located under the movable member 48, and a piezoelectric element or crystal 52 is interposed between the member 48 and 50. The warp yarns 44 are pressed against the guide member 48 in their tensioned state by the rollers 40 and 42 to exert a pressure on the piezoelectric element 52 through the member 48. The piezoelectric element 52 is deformed by the pressure applied thereto to generate an electric output signal or voltage having a value such as an intensity or magnitude representing or varying with tension in the warp yarn 12. The support member 50 supports the guide member 48 and the piezoelectric element 52 thereon.

Figure 2:
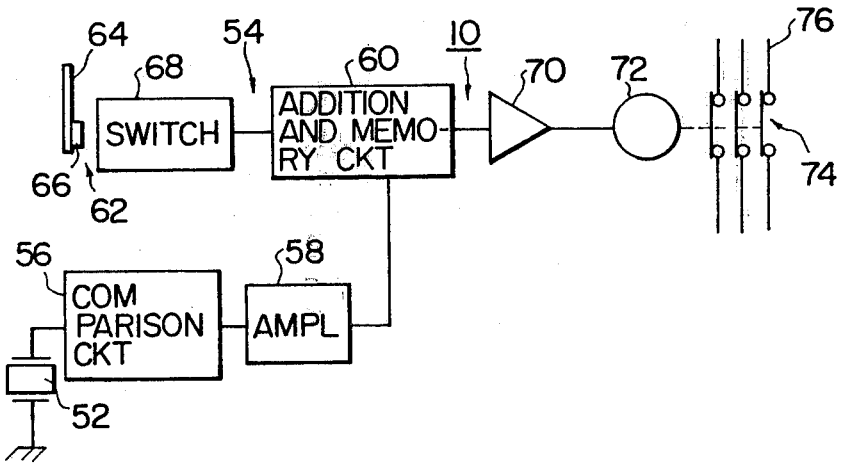
FIG. 2 is a schematic diagram of an electric control circuit forming the other part of the embodiment shown in FIG. 1.

Referring to FIG. 2 of the drawings, there is shown an electric control circuit 54 incorporating theretinto the piezoelectric element 52 grounded at one end or electrode. The piezoelectric element 52 is connected at the other end, or electrode, to a comparison or comparator circuit 56 which compares the value of the output signal applied from the piezoelectric element 52 with a base or reference value and generates an electric output signal when it receives an output signal of the element 52 having a magnitude greater than the reference value. The comparison circuit 56 is connected to an amplifier 58 which is connected to an input or reset terminal of an adding and memory circuit 60. The amplifier 58 amplifies the output signal from the comparison circuit 56 to generate an electric output signal which indicates the presence of a weft yarn 24 completely or normally inserted into the warp shed 22 and is applied to the adding and memory circuit 60 as a reset signal.

The adding and memory circuit 60 is connected at the other input terminal to a pulse generator 62. The pulse generator 62 includes a rotary arm 64 which is rotated in synchronism with rotation of a main drive shaft (not shown) of the loom, an iron piece 66 fixedly secured to a free end of the rotary arm 64, and a switch 68 stationarily mounted to face the locus of rotation of the iron piece 66 and located at a position adjacent to the iron piece 66. The switch 68 generates a pulse signal applied to the adding and memory circuit 60 when the iron piece 66 faces the switch 68, that is, each cycle operation of the loom.

The adding memory circuit 60 serves to generate an electric output signal for stopping operation of the loom when the sensor 46 successively senses tension in the warp yarn 12 which is lower than a predetermined value during a plurality of successive beat-ups which are, for example, two successive beat-ups in this embodiment, and accordingly when the comparison circuit 56 does not successively generate an output signal the same number of times as the plurality of successive beat-ups (two times in this embodiment). The adding and memory circuit 60 is constructed and arranged such that the pulse signal from the pulse generator 62 is totalled at each reception of the pulse signal as one per one reception thereof to get a total thereof, and such that the total of the pulse signal or signals is nullified or restored to zero when the adding and memory circuit 60 receives the output or reset signal of the amplifier 58. The adding and memory circuit 60 generates an electric output signal when the total of the pulse signals amounts to a number (three in this embodiment) greater than the number of times of the plurality of successive beat-ups during which no output signal is successively generated by the comparison circuit 56.

It is proper that the application timing of the pulse and rest signals to the adding and memory circuit 60 is such that, after the pulse signal has been supplied from the pulse generator 62 to the adding and memory circuit 60, the reset signal is supplied from the amplifier 58 to the adding and memory circuit 60. The adding and memory circuit 60 is connected at its output terminal to an amplifier 70 which is connected to a relay 72 for opening and closing switch means 74 disposed in a power supply line 76 connected to drive means (not shown) of the loom. The amplifier 70 amplifies the output signal from the adding and memory circuit 60 to generate an electric output signal applied to the relay 72. The relay 72 is normally deenergized to cause the switch means 74 to close the power supply line 76 and is, when it receives the output signal of the amplifier 70, energized to cause the switch means 74 to open the power supply line 76.

Figure 3:
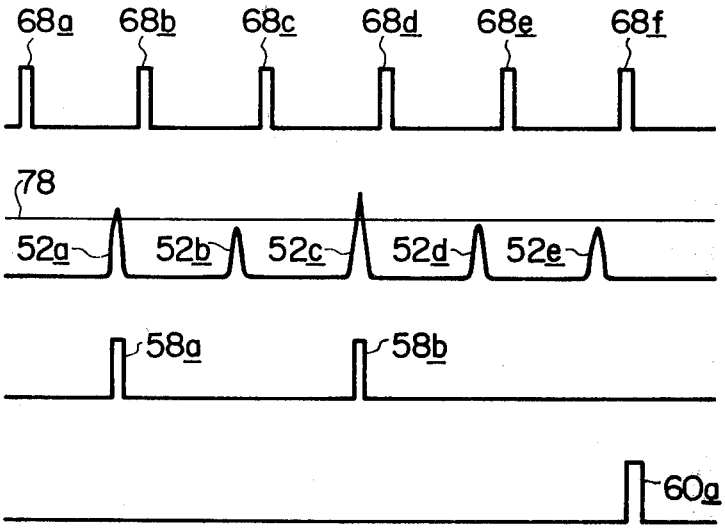
FIG. 3 is a diagram showing the relationship between several electric signals generated in the circuit shown in FIG. 2.

The apparatus 10 thus far described is operated as follows: Reference is also made to FIG. 3 of the drawings.

When the rotary arm 64 is rotated in synchronism with the main drive shaft of the loom and the iron piece 66 faces the switch 68 at a cycle of operation of the loom, a pulse signal **68*a* is generated by the switch 68. The adding and memory circuit 60 remembers the pulse signal 68*a* as a total of 1 pulse signal or provides a condition of a total of 1 pulse signal. Under this state, when the tension in the warp yarn 12 is increased above a predetermined value at beat-up with a weft yarn 24 completely or normally inserted into the warp shed 22, the piezoelectric element 52 generates an output signal 52*a* representing the increased warp tension. The comparison circuit 56 senses the value of the output signal 52*a* being greater than the reference value 78 to generate an output signal. The amplifier 58 responds to the output signal from the comparison circuit 56 to generate an amplified output signal 58*a* representing attainment of normal insertion of the weft yarn 24 into the warp shed 22. The total of the pulse signal stored by the adding and memory circuit 60, which is one, is restored to zero by the output signal 58*a***.

When the iron piece 66 faces the switch 68 at next cycle of operation of the loom so that the switch 68 generates a pulse signal **68*b*, the adding and memory circuit 60 stores the pulse signal 68*b* as a total of one pulse signal. Under this state, when tension in the warp yarn 12 is lower than the predetermined value at beat-up for any reason such as vibration of the loom notwithstanding that a weft yarn 24 has been normally inserted into the warp shed 22, the piezoelectric element 52 generates an output signal 52*b* representing the warp tension. The comparison circuit 56 senses the value of the output signal 52*b* being less than the reference value 78 to generate no output signal. As the amplifier 58 generates no reset signal, the total of the pulse signal stored by the adding and memory circuit 60** is maintained at one.

When a pulse signal **68*c* is generated with the iron piece 66 facing the switch 68 at the next cycle of operation of the loom, the adding and memory circuit 60 stores a total of two pulse signals in response to the pulse signal 68*c*. Under this state, when tension in the warp yarn 12 is increased above the predetermined value at beat-up with a weft yarn 24 normally inserted into the warp shed 22, the piezoelectric element 52 generates an output signal 52*c* representing the increased warp tension. The comparison circuit 56 senses the value of the output signal 52***c* being larger than the reference value 78 to generate an output signal. The amplifier 58 responds to the output signal of the comparison circuit 56 to generate an amplified output signal 58*b*. The total of the pulse signals stored in the adding and memory circuit 60 which is two is restored to zero by the output signal 58*b*.

When a pulse signal 68*d* is generated with the switch 68 facing the iron piece 66 at the subsequent cycle of operation of the loom, the adding and memory circuit 60 stores the pulse signal 68*d* as a total of one pulse signal. Under this state, when the sensor 46 senses tension in the warp yarn 12 less than the predetermined value at beat-up of this cycle for any reason such as no weft yarn being normally inserted into the warp shed 22, the piezoelectric element 52 generates an output signal 52*d*. The comparison circuit 56 senses the value of the output signal 52*d* being lower than the reference value to generate no output signal. Accordingly, since the amplifier 58 generates no reset signal, the total of the pulse signal stored in the adding and memory circuit 60 is maintained at one.

When a pulse signal 68*e* is generated at the next cycle of operation of the loom, the adding and memory circuit 60 stores a total of 2 pulse signals in response to the pulse signal 68*e*. Under this state, when no weft yarn was completely or normally inserted into the warp shed 22 in fact at the previous cycle, the piezoelectric element 52 generates an output signal 52*e* which represents tension in the warp yarn 12 being lower than the predetermined value at the beat-up of the present cycle irrespective of a weft yarn having been normally inserted into the warp shed 22 at the present cycle or not. The comparison circuit 56 responds to the value of the output signal 52*e* being lower than the reference value to generate no output signal. Since the amplifier 58 generates no reset signal, the total of the pulse signals stored in the adding and memory circuit 60 is maintained at two.

When a pulse signal 68*f* is generated by the switch 68 facing the iron piece 66 at the next cycle of the loom, the total of the pulse signals counted up by the adding and memory circuit 60 in response to the pulse signal 68*f* amounts to three. Thus, an output signal 60*a* is generated by the adding and memory circuit 60. The amplifier 70 responds to the output signal 60*a* to generate an amplified output signal. The relay 72 is energized by the output signal of the amplifier 70 to open the switch means 74 so that operation of the loom is stopped.

It will be appreciated that the invention provides a method and an apparatus in which operation of a weaving loom is stopped only when tension in the warp yarn less than a reference value at beat-up is consecutively sensed at a plurality of consecutive beat-ups so that operation of the loom is prevented from being unnecessarily stopped notwithstanding that insertion of a weft yarn into the warp shed has been completely carried out without trouble. Thus the rate of operation of the loom is increased.

What is claimed is:

1. An apparatus for stopping the operation of a weaving loom when woven fabric of the weaving loom lacks a weft yarn completely inserted, said apparatus comprising, first means for sensing the tension in a warp yarn existing between a back rest roller of a weaving loom and the fell of the woven fabric at each beat-up and for generating a first signal having a value representative of the sensed tension in the warp yarn, second means comprising comparator means electrically connected to said first means for receiving said first signal therefrom for comparing the value of said first signal from said first means with a reference value and for generating a second signal when the value of said first signal is greater than said reference value, a pulse generator for generating successive pulse signals each generated at each successive cycle of the weaving loom, and third means comprising means electrically connected to said pulse generator for receiving said pulse signals therefrom for adding said pulse signals on one-by-one reception of said pulse signals to obtain a total thereof at each reception of each of said pulse signals;

means electrically connected to said second means for receiving said second signal therefrom for restoring said total to zero in response to said second signal from said second means, and means for generating a third signal for stopping the operation of the weaving loom when said total has reached a predetermined number exceeding two.

2. An apparatus as claimed in claim 1, in which said first means comprises a guide member engaging and guiding the warp yarn and against which the warp yarn is pressed in its tensioned state, and a piezoelectric element located beneath said guide member and receiving pressure thereon from the warp yarn through said guide member and generating said first signal having a value representative of the tension in the warp yarn, and said pulse generator comprises a rotary arm rotated in synchronism with each cycle of the weaving loom, an iron piece fixedly secured to a free end of said rotary arm, and a switch mounted stationarily relative to said rotary arm and located at a position to face the path of rotation of said iron piece, said switch comprising means for generating said pulse signal every time said iron piece faces said switch, and means for connecting said switch electrically to said third means for feeding said pulse signal thereto.

3. An apparatus for stopping the operation of a weaving loom when woven fabric on the loom lacks a weft yarn comprising detection means for detecting after each beat-up the presence and lack of complete insertion of a weft yarn in a woven fabric being made on a loom and as a function of existence of a difference in the tension of the warp yarn and a predetermined tension thereof, a pulse generator for generating successive pulse signals each generated at each successive cycle of the weaving loom, means electrically connected to said pulse generator for receiving said pulse signals therefrom for adding said pulse signals on one-by-one reception of said pulse signals to obtain a total thereof at each reception of each of said pulse signals, means electrically connected to said detection means for restoring said total to zero in response to one detection of said presence of insertion of the weft yarn, and means for stopping the operation of the weaving loom when said total has reached a predetermined number exceeding one.

* * * * *